United States Patent [19]

Uzaki et al.

[11] Patent Number: 4,467,855

[45] Date of Patent: Aug. 28, 1984

[54] METHOD OF MAKING MOLD

[75] Inventors: Nagato Uzaki, Toyohashi; Toshihisa Komori, Toyokawa; Kazuharu Matui, Toyokawa; Shigehiro Toyoda, Toyokawa, all of Japan

[73] Assignee: Sintokogio Ltd., Nagoya, Japan

[21] Appl. No.: 320,694

[22] Filed: Nov. 12, 1981

[51] Int. Cl.[3] ..... B22C 15/00; B22C 9/12

[52] U.S. Cl. ..... 164/7.1; 164/16

[58] Field of Search ..... 164/7.1, 7.2, 170, 160.1, 164/160.2, 16

[56] References Cited

U.S. PATENT DOCUMENTS 4,129,165 12/1978 Edwards ..... 164/7.1

FOREIGN PATENT DOCUMENTS 0074351 6/1981 Japan ..... 164/7.1

*Primary Examiner*—Kuang Y. Lin

*Attorney, Agent, or Firm*—Armstrong, Nikaido, Marmelstein & Kubovcik

[57] ABSTRACT

A method of making a mold having the steps of supplying a molding sand containing a gas-hardenable binder into a space defined by a patter plate and a molding flask, covering the upper surface of the molding sand in a gas-tight manner with a film sheet, bringing the space in the molding flask into communication with a vacuum source to reduce the pressure in the space thereby to squeeze the molding sand by means of the film sheet, closing, after removing the film sheet, the upper opening of the molding flask, and connecting a hardening gas source to the space in the molding flask while reducing the pressure in the space to induce a hardening gas into the molding flask to make the gas penetrate the molding sand, thereby to harden the molding sand.

1 Claim, 6 Drawing Figures

METHOD OF MAKING MOLD

BACKGROUND OF THE INVENTION

The present invention relates to a method of making a mold and, more particularly, to a method suitable for carrying out so-called "cold box process" or "$SO_2$ process" in which molding sand containing a gas-hardenable binder is supplied into a space defined by a pattern plate and a molding flask and, after a squeezing of the molding sand, a hardening gas is supplied to penetrate the molding sand to harden the molding sand thereby to form the mold.

In general, the formation of a mold by the "cold box process" or "$SO_2$ process" requires various devices such as a squeezing device for squeezing the molding sand, gas blowing device for blowing the hardening gas into the molding sand, clamp device for clamping a pattern plate and a molding flask firmly to prevent the escape of the hardening gas, and so forth. The sizes of these devices get larger as the size of the mold to be formed becomes greater. The increased size of the mold to be formed also requires an increased force produced by the gas pressure which in turn requires a construction which has a strength high enough to withstand the increased force.

Generally, as the size of the mold to be formed is increased beyond a certain limit, it becomes difficult to mechanically squeeze the molding sand and a considerably long time is required for the satisfactory squeezing. In some cases, it is necessary to adopt a stamping work requiring a manual labour.

SUMMARY OF THE INVENTION

Accordingly, an object of the invention is to provide a method of making a mold in which the squeezing of the molding sand, as well as the penetration of the hardening gas, can be achieved quite easily.

Another object of the invention is to provide a method of making a mold which assures a sufficient application of the hardening gas to the molding sand while avoiding the escape of the hardening gas to the outside.

Still another object of the invention is to provide a method of making a mold which can be carried out economically at a low cost and without the fear of environmental pollution.

A further object of the invention is to provide a method of making a mold which can minimize the consumption of the molding sand.

To these ends, according to one aspect of the invention, there is provided a method of making a mold in which molding sand containing a gas-hardenable binder is supplied into a space defined by a pattern plate and a mold flask and, after a squeezing of said molding sand, a hardening gas is supplied to said molding sand thereby to harden the latter, comprising the steps of: covering, after supplying said molding sand into said space, the upper side of said molding sand with a film sheet in a gas-tight manner, and bringing said space into communication with a vacuum source to establish a vacuum in said space to squeeze said molding sand by means of said film sheet; and, after removal of said film sheet, placing a cover member having a gas supplying port on the upper side of said molding flask, connecting said space to a hardening gas source through the port of said cover member, and reducing the pressure in said space to positively induce a hardening gas from said source into said space to make said gas penetrate the squeezed molding sand thereby to harden said molding sand.

These and other objects, features and advantages of the invention will become clear from the following description of the preferred embodiments taken in conjunction with the accompanying drawings.

DESCRIPTION OF THE PREFERRED EMBODIMENTS

Figure 1:
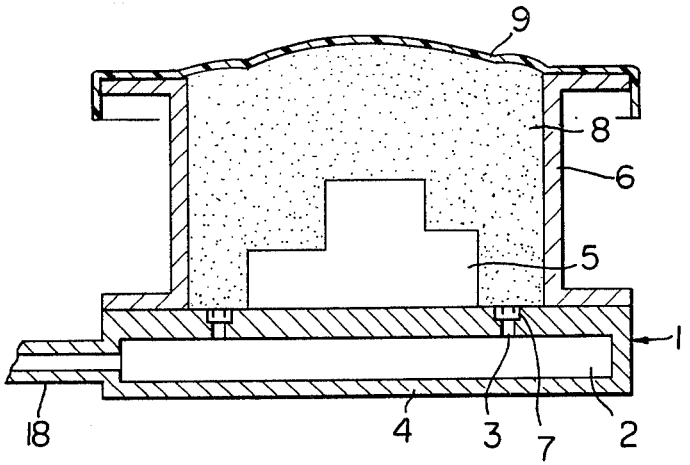
FIG. 1 is a sectional view of an apparatus for carrying out a method of the invention, in the step of squeezing the molding sand.

A pattern plate 1 is composed of a suction box 4 and a pattern 5 attached to the upper side of the suction box 4. The suction box 4 has a vacuum chamber 2 formed therein and a plurality of vent holes 3 formed in the top wall thereof to communicate with the vacuum chamber 2. A molding flask 6 is placed on the pattern plate 1. The molding flask 6 is located with using locating pins which are not shown.

Each vent hole 3 receives therein a vent plug 7 which acts to prevent the molding sand from discharged therethrough.

The space defined by the pattern plate 1 and the molding flask 6 is charged with a molding sand 8. A flexible film sheet 9 such as a synthetic resin film or a rubber sheet is placed on the sand 8 in a gastight manner. A reference numeral 10 designates a cover member which is provided at its lower side with a recess 11 and a central gas supplying port 12 as will be seen from FIG. 2. The cover member 10 is placed on the molding flask 6 in such a manner that, due to the recess 11, a small gap is formed between the lower side of the cover member 10 and the upper face of the molding sand 8.

Figure 2:
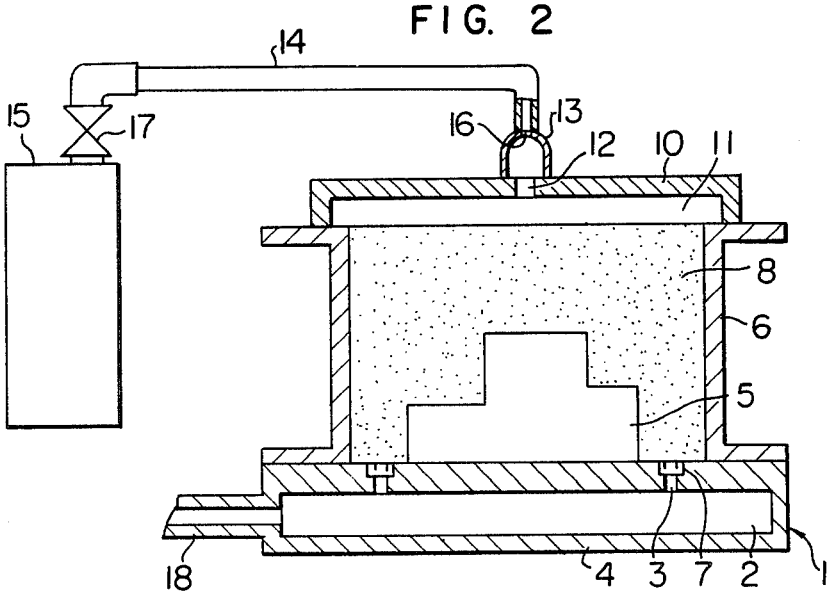
FIG. 2 is a sectional view of the apparatus shown in FIG. 1, in the step of supplying the molding sand with a hardening gas.

An inverse U-shaped cap 13 having a gas supplying hole 16 is placed to cover the gas supplying port 12. The space inside the cap 13 is communicated with a hardening gas generating device 15 through a flexible conduit 14, and a stop valve 17, as shown in FIG. 2. A suction pipe 18 is connected at its one end to the vacuum chamber 2 and at its other end to a vacuum pump via a deodorant device. The vacuum pump and the deodorant device are not shown.

In making the mold, the molding flask 6 is placed on the pattern plate 1 and the molding sand containing a gas-hardenable binder is charged into the space formed by the pattern plate 1 and the molding flask 6. Then, after covering the upper surface of the molding flask 6 with the film sheet 9 in a gas-tight manner, the vacuum pump (not shown) is started so that the space inside the molding flask 6 is evacuated through the vacuum chamber 2 and the vent holes 3, so that the molding sand 8 in the molding flask 6 is squeezed by means of the film sheet 9 so as to be compacted uniformly. This step is illustrated in FIG. 1.

Thereafter, the film sheet 9 is taken away, and the molding sand 8 in the upper part of the molding flask 6 is scraped and removed, thereby the upper surface of the molding sand being flat. Then, the cover member 10 is placed on the molding flask 6 and the cap 13, the hole 16 of which is communicated with the hardening gas generating device 15 through the conduit 14, is placed on the cover member 10 to cover the gas supplying port 12.

At first, the vacuum pump (not shown) is started, and then the stop valve 17 is opened, so that the hardening gas generated and stored in the gas generating device is induced and sucked into the molding flask 6, through the conduit 14, hole 16 of the cap 13, gas supplying hole 12, recess 11 and so forth. The hardening gas is then sucked so as to penetrate the molding sand 8, and further pass through the vent plugs 7, vent holes 3, vacuum chamber 2 and the suction pipe 18. The gas is then sucked through the deodorant device (not shown) by the vacuum pump (also not shown).

After supplying the molding sand with the hardening gas for a predetermined time, the cap 13 is removed while continuing the operation of the vacuum pump to suck and remove the residual hardening gas from the molding sand 8, which is followed by a stripping thus completing the making of the mold.

In the described embodiment, the major works, i.e. the squeezing of the molding sand and the penetration by the hardening gas, are achieved solely by the sucking action of the vacuum pump. This fact offers various advantages. For instance, the components such as the pattern plate 1, molding flask 6, cover member 10 and so forth need not have any pressure-resistant construction nor any specific structure for preventing the leak or escape of the gas.

Figure 3:
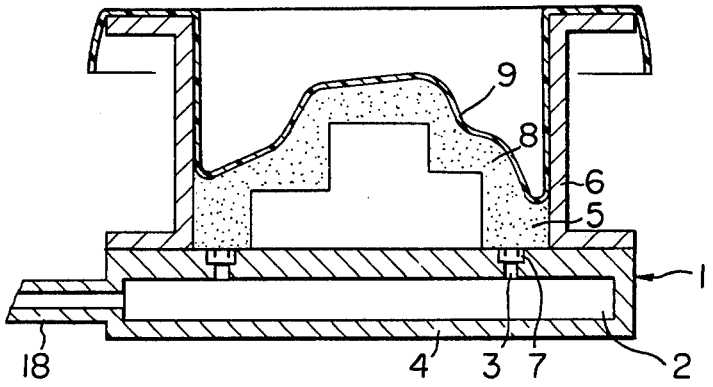
FIG. 3 is a sectional view of an apparatus for carrying out a method in accordance with another embodiment, in the step of squeezing the molding sand.
Figure 4:
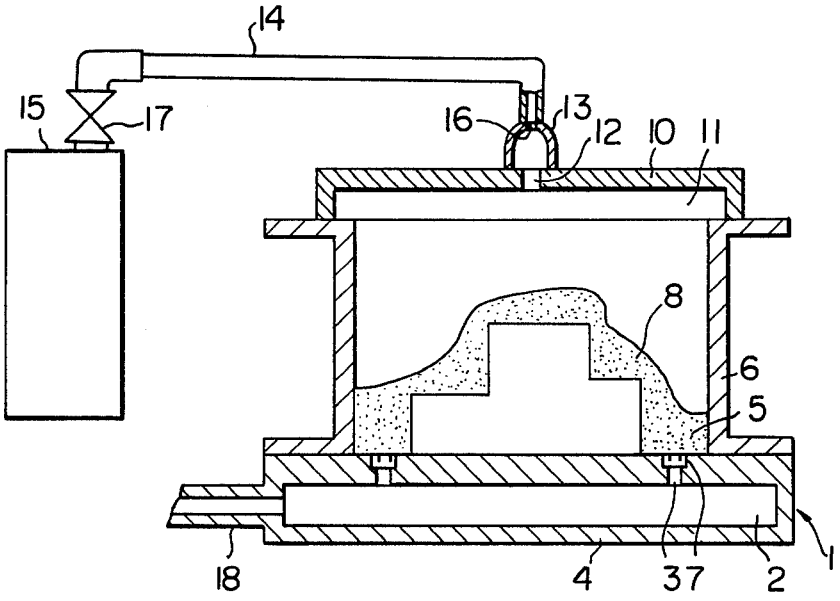
FIG. 4 is a sectional view of the apparatus shown in FIG. 3, in the step of supplying the molding sand with a hardening gas.

FIGS. 3 and 4 illustrate another embodiment of the invention in which the molding sand 8 is supplied to provide a substantially uniform thickness of the sand along the upper surface of the pattern plate 1 as shown in FIG. 3, and, after placing the film sheet 9 in a gas-tight manner on the molding sand 8, the squeezing of the molding sand 8 is effected in the same way as in the embodiment shown in FIGS. 1 and 2, which is followed by the penetration by the hardening gas as shown by FIG. 4, to obtain a shell-type mold. According to this embodiment, it is possible to reduce the consumption of the hardening gas and the molding sand.

Figure 5:
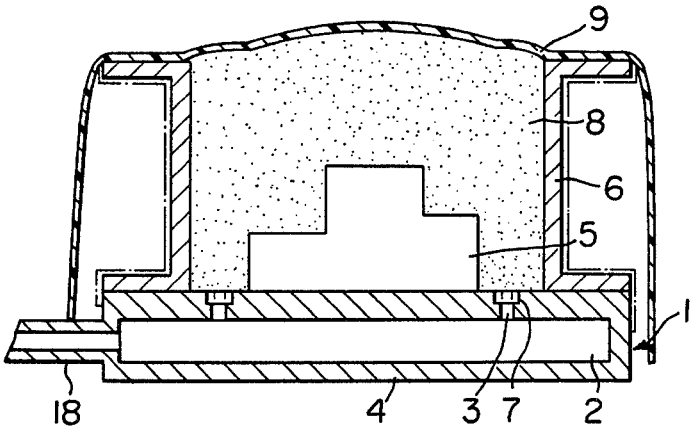
FIG. 5 is a sectional view of an apparatus for carrying out a method in accordance with still another embodiment, in the step of squeezing the molding sand.
Figure 6:
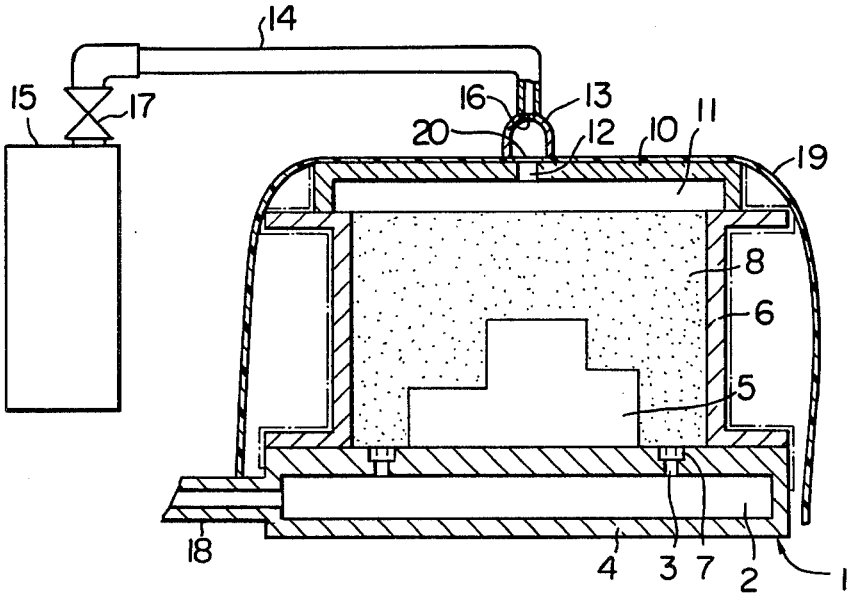
FIG. 6 is a sectional view of the apparatus shown in FIG. 5, in the step of supplying the molding sand with a hardening gas.

FIGS. 5 and 6 illustrate still another embodiment of the invention which applies to the case where the prevention of introduction of ambient air is essential during the process including the squeezing step and the hardening gas supply step. In this case, the film sheet 9 is made to have a width large enough to cover all inclusive of the juncture between the pattern plate 1 and the molding flask 6. In addition, during the supply of the hardening gas, another film sheet 9 having a hole 20 is placed on the cover member 10 as illustrated in FIG. 6 to prevent the ambient air from coming into the molding sand.

Although the invention has been described through specific terms, it is to be noted that the described embodiments are not exclusive, and various changes and modifications may be imparted thereto without departing from the scope of the invention which is limited solely by the appended claims.

What is claimed is:

1. A method for making a mold comprising the steps of:

charging molding sand containing a gas-hardenable binder, into a space defined between a molding flask and a pattern plate, said molding flask having a top, outer lateral surfaces and bottom, said pattern plate having vent holes therethrough and a portion for mating with said bottom of said flask defining a parting plane therebetween;

stretching a flim sheet so as to gas-tightly cover all of the extent from the top of the charged molding sand to the mating portion between the bottom of the molding flask and the pattern plate including the top and the outer lateral surface of the flask, the film sheet extending past the parting plane;

evacuating the air from said space through the vent holes in the pattern plate so that the film sheet uniformly squeezes and compacts the molding sand while sealing the molding flask down to and past the parting plane from ambient air;

removing said film sheet;

placing a cover member on the top of the molding flask, said cover member having a top and a gas supply port adapted to supply therethrough a hardening gas from a hardening gas generating device to said space;

stretching another film sheet so as to gas-tightly cover all of the extent between the top of the cover member to the mating portion between the molding flask and the pattern plate including the top of the cover member and the outer lateral surfaces of the flask, said another film sheet extending past the parting plane;

placing a cap on said another film sheet on said cover member so as to cover said gas supply port, said cap having a hole through which said cap is communicated with said hardening gas generating device; and evacuating air from said space and supplying hardening gas to said space for influencing said gas through the molding sand so as to harden the molding sand, said another film sheet sealing said cover member and the molding flask down to and past the parting plane from ambient air.

* * * * *